US007593664B2

(12) United States Patent
Okabe

(10) Patent No.: US 7,593,664 B2
(45) Date of Patent: Sep. 22, 2009

(54) IMAGE-FORMING DEVICE AND BELT UNIT HAVING BELT TENSION-ADJUSTING MECHANISM

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 314 days.

(21) Appl. No.: 11/376,115

(22) Filed: Mar. 16, 2006

(65) Prior Publication Data

US 2006/0216056 A1 Sep. 28, 2006

(30) Foreign Application Priority Data

Mar. 25, 2005 (JP) ..... 2005-089137

(51) Int. Cl.
*G03G 15/16* (2006.01)

(52) U.S. Cl. ..... 399/101; 399/165; 399/297; 399/302; 399/303

(58) Field of Classification Search ..... 399/165, 399/297, 302, 303, 101
See application file for complete search history.

(56) References Cited

U.S. PATENT DOCUMENTS

| | | | | |
|---|---|---|---|---|
| 5,258,816 | A * | 11/1993 | Haneda et al. | 399/165 |
| 6,249,662 | B1 | 6/2001 | Lee | |
| 6,823,166 | B2 | 11/2004 | Nishiwaki | |
| 2003/0223784 | A1 | 12/2003 | Yamanaka et al. | |
| 2005/0002693 | A1 * | 1/2005 | Pak et al. | 399/165 |

FOREIGN PATENT DOCUMENTS

| | | |
|---|---|---|
| CN | 1439937 | 9/2003 |
| JP | 9-230759 | 9/1997 |
| JP | 2000-136045 | 5/2000 |
| JP | 2000-172122 | 6/2000 |
| JP | 2000-289878 A | 10/2000 |
| JP | 2000-305372 | 11/2000 |
| JP | 2002-258629 A | 9/2002 |
| JP | 2003-280403 | 10/2003 |

OTHER PUBLICATIONS

Electronic Translation of JP 2000289878, Hirai et al.*
CN Office Action dtd Mar. 28, 2008, CN App 2006100718915.

* cited by examiner

*Primary Examiner*—David M Gray
*Assistant Examiner*—Ryan D Walsh
(74) *Attorney, Agent, or Firm*—Banner & Witcoff, Ltd.

(57) ABSTRACT

A color laser printer includes a plurality of photosensitive drums and a paper-conveying belt disposed in confrontation with the photosensitive drums. The paper-conveying belt conveys a sheet of paper as the photosensitive drums sequentially transfer toner images thereon. This printer also includes a tension-adjusting mechanism capable of adjusting the tension state produced in the paper-conveying belt, and a controller for controlling the tension-adjusting mechanism. Through the control of the controller, the tension-adjusting mechanism is capable of adjusting the tension state of the paper-conveying belt between a first tension state used for transferring toner images from the photosensitive drum, and a second tension state producing a tension greater than that produced by the first tension state for performing a cleaning operation.

11 Claims, 9 Drawing Sheets

IMAGE-FORMING DEVICE AND BELT UNIT HAVING BELT TENSION-ADJUSTING MECHANISM

CROSS REFERENCE TO RELATED APPLICATIONS

This application claims priority from Japanese Patent Application No. 2005-089137 filed Mar. 25, 2005. The entire content of the priority application is incorporated herein by reference.

TECHNICAL FIELD

The disclosure relates to an image-forming device and a belt unit employed in the image-forming device.

BACKGROUND

Some image-forming devices well known in the art are configured of image-carrying members for carrying developer images, and a belt disposed in confrontation with the image-carrying members so that the image-carrying members transfer developer onto the belt or onto a recording medium conveyed along the belt. In this type of image-forming device, the belt is adjusted to an appropriate tension for performing the transfers.

Japanese Patent Publication No. 2000-305372 proposes a technique for setting the tension state of the belt in a halted state lower than the tension state during a transfer operation. With this construction, a tension suitable for a transfer operation is generated in the belt when the belt is driven to perform a transfer operation, thereby ensuring stable movement of the belt. On the other hand, when the belt is halted for a long period of time, the tension in the belt is reduced from that during a transfer operation to prevent the belt from becoming misshapen (stretching that lingers in the belt due to pressure being applied in specific areas of the belt over a long period of time).

SUMMARY

While this construction can reduce the tension in the belt for certain situations, there are some cases in which a greater belt tension than that during a transfer operation is desired. For example, when a mechanism is provided for cleaning the belt, a cleaning member in this mechanism is placed in contact with the belt for removing foreign matter from the surface of the belt by applying a load thereto. However, since this cleaning member applies a large load to the belt during cleaning, it is preferable to produce a larger tension in the belt to ensure proper cleaning. However, generating a constant, large tension in the belt may cause the belt to wear faster or lead to other problems. Therefore, it is desirable to set the belt at a greater tension only when necessary.

In view of the foregoing, it is an object of the present invention to provide an image-forming device and a belt unit capable of setting the tension state in the belt greater than the state during a transfer operation.

This and other objects of the invention will be attained by an image-forming device including an image-carrying member, a plurality of support members, an endless belt, a transferring member, and a tension-adjusting mechanism.

The image-carrying member carries a developer image. The endless belt is disposed in confrontation with the image-carrying member and is supported on the plurality of support members to circularly move there around. The transferring member transfers the developer image in a direction from the image-carrying member to the endless belt. The tension-adjusting mechanism adjusts a tension generated in the endless belt between a first tension at which the developer image is transferred in the direction from the image-carrying member to the endless belt and a second tension greater than the first tension.

In another aspect of the invention, there is provided a belt unit including a plurality of support members, an endless belt, and a tension-adjusting mechanism.

The endless belt is supported on the plurality of support members to circularly move there around. The tension-adjusting mechanism adjusts a tension generated in the endless belt between a first tension at which a developer image is transferred in a direction from an image-carrying member to the endless belt and a second tension greater than the first tension.

DETAILED DESCRIPTION

Next, an image-forming device according to a first embodiment of the present invention will be described while referring to the accompanying drawings.

Figure 1:
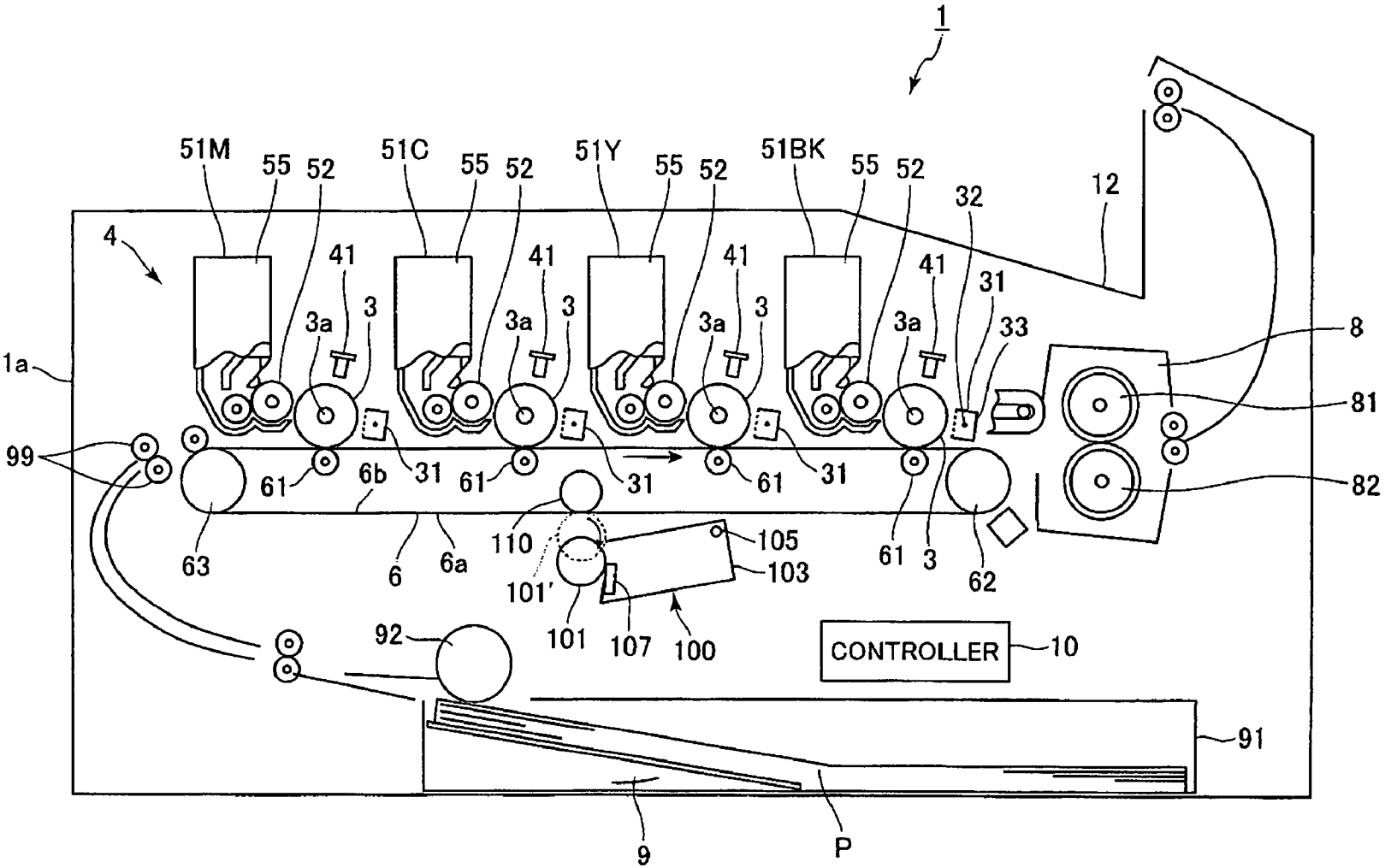
FIG. 1 is a cross-sectional view of an image-forming device according to a first embodiment of the present invention.

As shown in FIG. 1, the printer 1 includes a toner-image-forming unit 4, a paper-conveying belt 6, a fixing unit 8, a paper supply unit 9, a stacker 12, and a controller 10 having a CPU, ROM, RAM, and the like. The printer 1 forms four-color images on a paper P based on image data inputted from an external source.

The toner-image-forming unit 4 includes four developing units 51M, 51C, 51Y, and 51BK accommodating toner in the colors magenta (M), cyan (C), yellow (Y), and black (BK), respectively. Each of the four developing units 51M, 51C, 51Y, and 51BK includes photosensitive drums 3, chargers 31, and an exposure device 41.

Next, each of these components will be described in greater detail.

The photosensitive drums 3 are configured of members substantially cylindrical in shape. The photosensitive drums 3 are rotatably supported on shafts 3*a* and are juxtaposed at regular intervals along the horizontal. The cylindrical member configuring each photosensitive drum 3 is formed of an aluminum base material that is coated with a positive charging photosensitive layer, for example. The aluminum base material is grounded on a ground line of the printer 1.

Each charger 31 is a Scorotron charger including a charging wire 32 extending along the width of the photosensitive drum 3, and a shielding case 33 open on the photosensitive drum 3 side for accommodating the charging wire 32. When a high voltage is applied to the charging wire 32, the charging wire 32 charges the surface of the photosensitive drum 3 with a positive polarity. The shielding case 33 includes a grid provided in the open area on the photosensitive drum 3 side. When a prescribed voltage is applied to the grid, the surface of the photosensitive drum 3 is charged to the same potential as the grid voltage.

The exposure device 41 is configured of an LED array and is disposed at positions over each photosensitive drum 3 downstream of the charger 31 in the rotational direction of the photosensitive drum 3. The exposure device 41 generates light from an LED in the LED array corresponding to one color component in image data inputted from an external source to irradiate light on the surface of the corresponding photosensitive drum 3. The exposure device 41 may also be configured of a scanner including a light source that emits laser light, and a polygon mirror that is driven to rotate by a motor for reflecting and scanning the laser light over the surface of the photosensitive drum 3.

When the exposure device 41 irradiates laser light onto the surface of the photosensitive drum 3 based on image data, the light reduces the surface potential of the photosensitive drum 3 at the exposed regions. In this way, an electrostatic latent image is formed on the surface of the photosensitive drum 3.

Each of the developing units 51 is configured of a developer case 55 for accommodating toner, and a developing roller 52 disposed in the developer case 55. The developing roller 52 is disposed in contact with the respective photosensitive drum 3 at a position downstream of the exposure device 41 in the rotational direction of the photosensitive drum 3. Each of the developing units 51 charges toner to a positive polarity and supplies a uniform thin layer of this toner to the photosensitive drum 3. At the point of contact between the developing roller 52 and the photosensitive drum 3, the positively charged toner carried on the surface of the developing roller 52 is attracted to the positive electrostatic latent image formed on the photosensitive drum 3, thereby forming a toner image on the surface of the photosensitive drum 3 through a reverse developing method.

The developing roller 52 is configured of a base material formed of an electrically conductive silicon rubber or the like in a cylindrical shape, the surface of which is coated with a synthetic resin containing fluorine or a rubber material. Toner accommodated in each developer case 55 is a nonmagnetic, single-component toner having a positive polarity. The developer cases 55 in the developing units 51M, 51C, 51Y, and 51BK accommodate toner in the colors magenta, cyan, yellow, and black, respectively.

The paper supply unit 9 is disposed in the lowest section of the printer 1 and includes a paper tray 91 for accommodating the paper P, and a pickup roller 92 for picking up and feeding the paper P. After the pickup roller 92 picks up and feeds the paper P from the paper tray 91 one sheet at a time, conveying rollers 99 receive each sheet of paper P and convey the sheet onto the paper-conveying belt 6.

The paper-conveying belt 6 has an endless loop shape that moves seamlessly while supporting the paper P on the top surface thereof. The paper-conveying belt 6 is looped around a drive roller 62 and a follower roller 63. Transfer rollers 61 are disposed at positions opposing each of the photosensitive drums 3.

Figure 2:
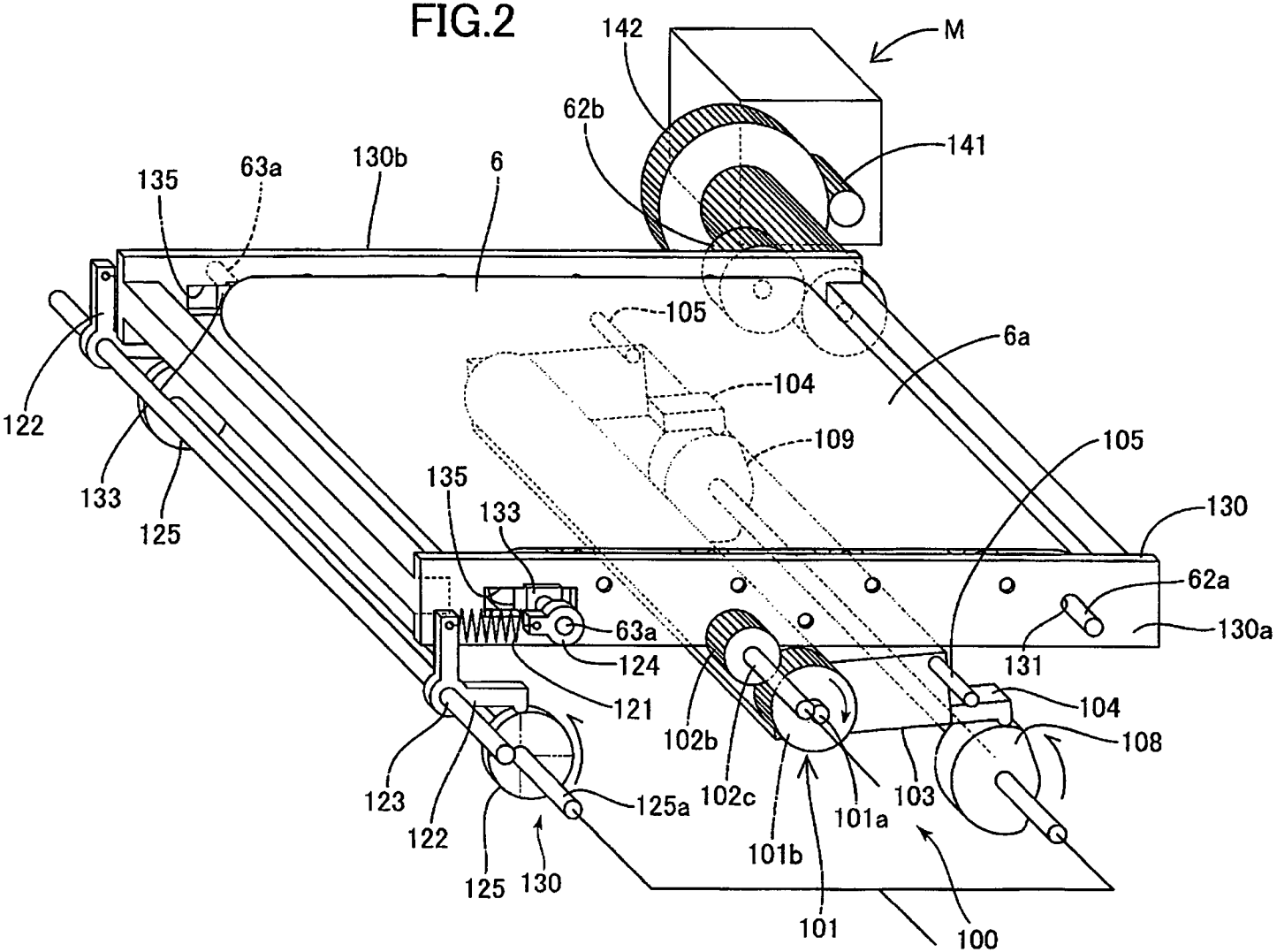
FIG. 2 is a perspective view showing the structure of the image-forming device in FIG. 1 around a paper-conveying belt.
Figure 3:
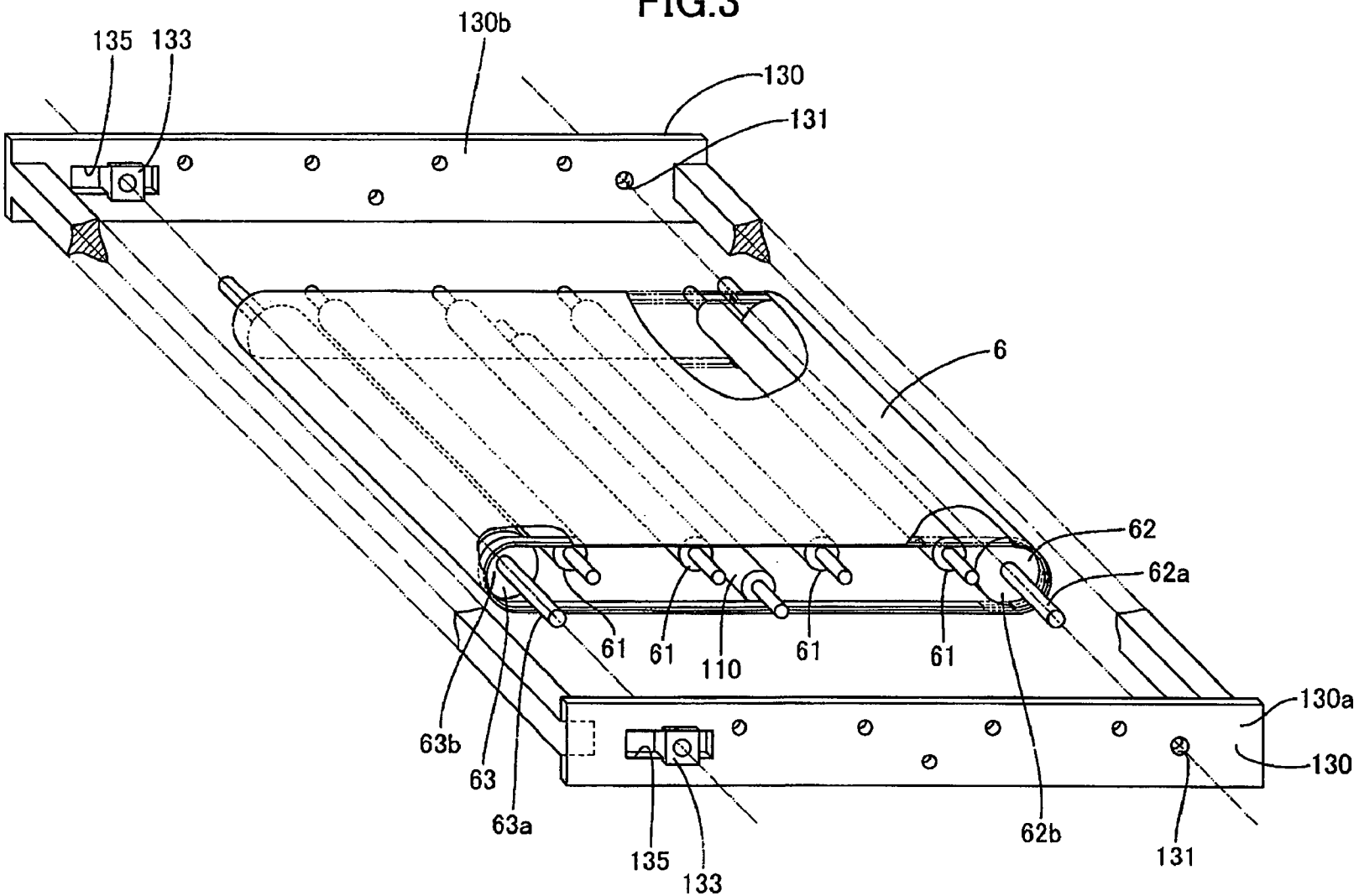
FIG. 3 is a perspective view of the paper-conveying belt structure in FIG. 2 in which a frame and the like have been dismantled.

As shown in FIG. 2, a frame 130 has side walls 130*a* and 130*b* for supporting the drive roller 62 and follower roller 63. The frame 130 is fixed in a main casing 1*a* (see FIG. 1) of the printer 1. More specifically, holes formed in the frame 130, as shown in FIG. 3, function as stationary bearings 131. The drive roller 62 is rotatably supported in the frame 130 by inserting a shaft 62*a* of the drive roller 62 into the bearings 131. A gear 62*b* is fixed to an end of the shaft 62*a* and transfers a driving force to a motor M to the shaft 62*a*. More specifically, the motor M has a drive shaft 141. A driving force produced by the drive shaft 141 is transferred to the gear 62*b* via a gear 142 for driving the drive roller 62 to rotate.

As shown in FIG. 3, the follower roller 63 includes a shaft 63*a*, and a roller portion 63*b*. The ends of the shaft 63*a* are supported in bearings 133 provided on the frame 130. Specifically, the shaft 63*a* is inserted into a hole formed in each of the bearings 133 and is rotatably supported therein. The bearings 133 are slidably disposed in through-holes 135 formed in the bearings 133 so as to be capable sliding along the inner surfaces of the through-holes 135. By sliding the bearings 133 in the through-holes 135, it is possible to increase and decrease the distance between the follower roller 63 and the drive roller 62. As shown in FIG. 2, retaining members 124 are rotatably supported on the ends of the shaft 63*a*. Spring members 121 (described later) urge the retaining members 124 in a direction away from the drive roller 62. By urging the follower roller 63 away from the drive roller 62 in this way, a degree of tension can be produced in the paper-conveying belt 6.

As shown in FIG. 1, the paper-conveying belt 6 moves in a circular manner when the drive roller 62 is driven to rotate so that an outer surface 6*a* moves in a left-to-right direction in FIG. 1 when opposite the photosensitive drums 3. Hence, a sheet of paper P conveyed by the conveying rollers 99 is conveyed on the outer surface 6*a* sequentially past each of the photosensitive drums 3 toward the fixing unit 8.

A constant current source (not shown) can be connected to the transfer rollers 61 for applying a transfer bias of reverse polarity to the positively charged toner between the transfer rollers 61 and the photosensitive drum 3 in order to transfer toner onto the paper P. With this construction, the transfer rollers 61 can transfer toner images formed on the photosensitive drums 3 onto the paper P conveyed by the paper-conveying belt 6.

The fixing unit 8 includes a heating roller 81 and a pressure roller 82. After toner images in four colors have been transferred onto the paper P, the heating roller 81 and pressure roller 82 pinch and convey the paper P while fixing the toner images to the paper P by heat and pressure.

As described above, the stacker 12 is formed on the top surface of the printer 1. The stacker 12 is disposed on the discharge end of the fixing unit 8 for receiving and accommodating the paper P discharged from the fixing unit 8.

The controller 10 is configured of a controlling device having a CPU well known in the art for controlling the overall operations of the printer 1. The controller 10 is connected to a ROM, RAM, or other type of storage device.

Next, an image-forming operation performed by the printer 1 on the paper P will be described. First, the pickup roller 92 picks up one sheet of paper P from the paper supply unit 9 and conveys the sheet to the paper-conveying belt 6 via the conveying rollers 99.

The charger 31 opposing the leftmost photosensitive drum 3 in FIG. 1 (the photosensitive drum 3 corresponding to the developing unit 51M for magenta) charges the surface of the photosensitive drum 3 uniformly with a prescribed voltage. The exposure device 41 exposes the surface of the photosensitive drum 3 based on image data for the color magenta inputted from an external source. The potential on the surface of the photosensitive drum 3 drops only in areas that were exposed, forming an electrostatic latent image on the surface of the photosensitive drum 3. Next, a positive developing bias is applied to the developing roller 52 in the developing unit 51M so that positively charged magenta toner carried on the surface of the developing roller 52 is supplied to the surface of the photosensitive drum 3.

The magenta toner is deposited only in areas on the surface of the photosensitive drum 3 having a lower potential than the developing bias, thereby developing the electrostatic latent image. Next, a negative transfer bias is applied to the transfer rollers 61 so that the positively charged toner image formed on the photosensitive drum 3 is transferred onto the surface of the paper P conveyed by the paper-conveying belt 6. Through this transfer process, a positively charged magenta toner image is deposited on the surface of the paper P.

Subsequently, the paper P is sequentially conveyed through positions opposing the photosensitive drums 3 for cyan toner, yellow toner, and black toner, at which time toner images in these colors are formed on the surface of the respective photosensitive drum 3 and are superimposed on the paper P according to the same process described for magenta toner, resulting in a four-color toner image being formed on the paper P. The four-color toner image is fixed to the paper P in the fixing unit 8, and the paper P is subsequently discharged onto the stacker 12.

As shown in FIG. 1, the printer 1 according to the preferred embodiment also includes a cleaning device 100 disposed adjacent to the surface of the paper-conveying belt 6 where the paper-conveying belt 6 has been inverted after passing around the drive roller 62. The cleaning device 100 includes a cleaning roller 101 that is rotatably placed in contact with the paper-conveying belt 6. The cleaning roller 101 is configured of a roller member formed of synthetic resin or metal and covered with silicon foam, urethane foam, or the like. A backup roller 110 formed of a metal roller member, for example, is disposed on the opposite surface of the paper-conveying belt 6 from the cleaning roller 101 so that the paper-conveying belt 6 is interposed between the cleaning roller 101 and backup roller 110. Hence, the backup roller 110 is disposed in contact with the paper-conveying belt 6 on the surface opposite the outer surface 6*a* (an inner surface 6*b*) and functions to pinch the belt together with the cleaning roller 101.

The cleaning device 100 also includes a cleaning blade 107 that contacts the cleaning roller 101 for scraping off toner that has become deposited on the cleaning roller 101, and a collecting box 103 for collecting toner removed by the cleaning blade 107.

Figure 4A:
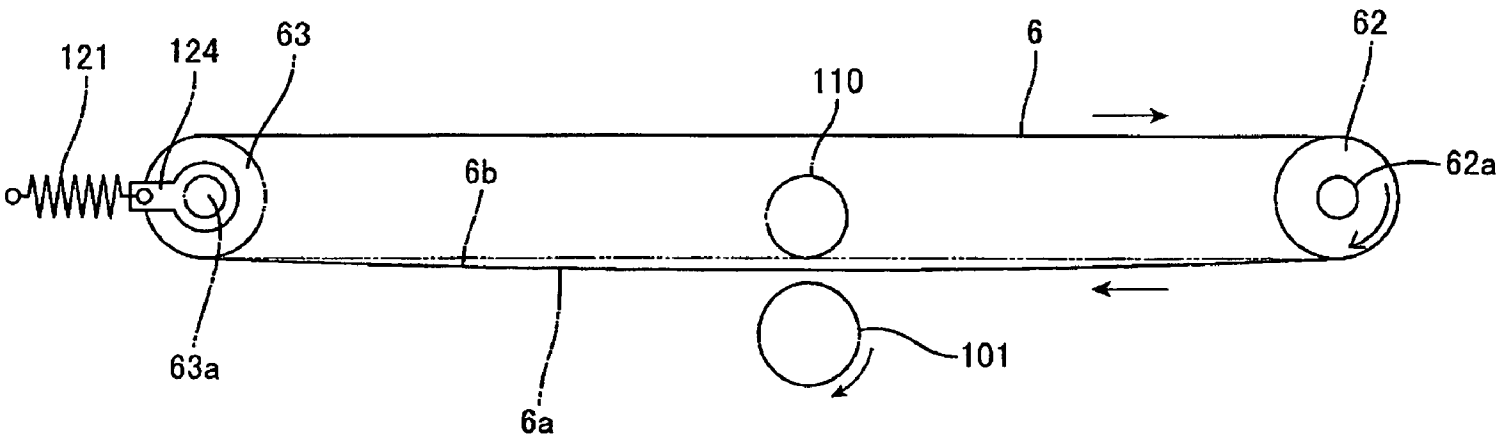
FIG. 4A is explanatory diagram illustrating the state of the belt during a transfer operation according to a first embodiment of the present invention.
Figure 4B:
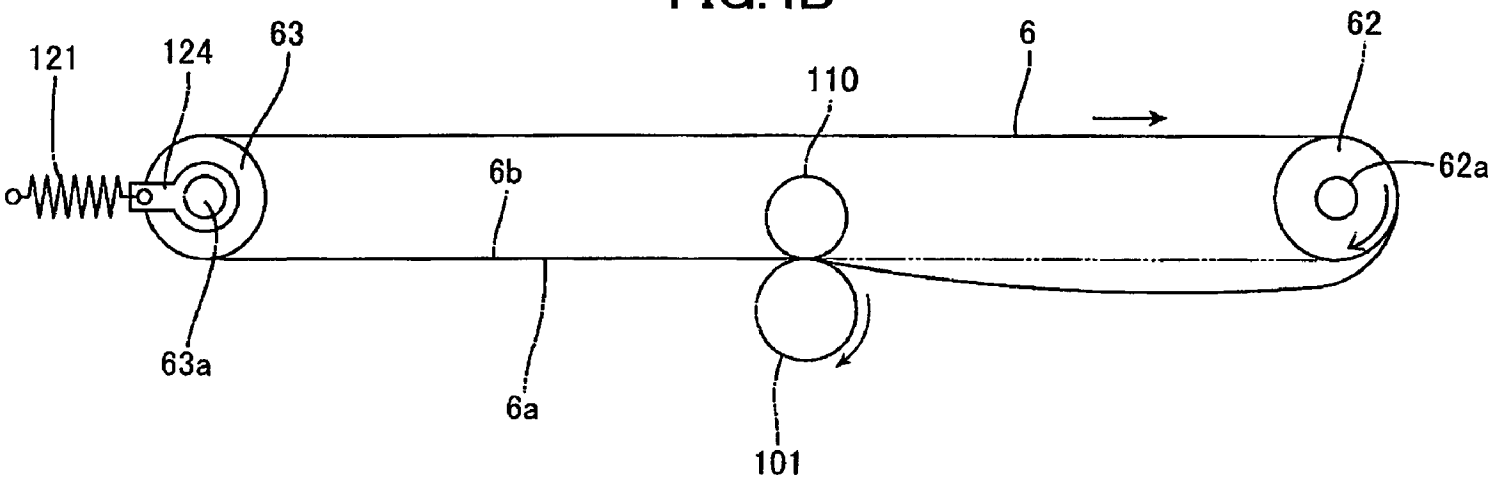
FIG. 4B is explanatory diagrams illustrating the state of the belt during a cleaning operation according to a first embodiment of the present invention.

The printer 1 according to the preferred embodiment is capable of forming toner images directly on the paper-conveying belt 6. For example, the printer 1 can form density patches and the like on the paper-conveying belt 6 to determine the density of the toner image. By providing the cleaning roller 101 adjacent to the paper-conveying belt 6, as described above, the cleaning roller 101 can remove toner that has been deposited on the paper-conveying belt 6. As shown in FIG. 2, the cleaning roller 101 is configured of a shaft 101*a*, and a gear 101*b* fixed to an end of the shaft 101*a*. A drive motor or other drive source (not shown) produces a driving force for rotating a gear 102*b*. The gear 102*b* transfers this driving force to the gear 101*b*, driving the gear 101*b* to rotate in a direction opposite the moving direction of the belt at the point of contact therewith, as shown in FIGS. 4A and 4B. Hence, the surface of the cleaning roller 101 moves opposite the direction in which the belt moves at the point of contact between the two.

During a process to remove toner from the paper-conveying belt 6, a constant voltage source (not shown) applies a bias of opposite polarity to the toner to the cleaning roller 101. With this construction, toner remaining on the paper-conveying belt 6 becomes attracted to the cleaning roller 101 when the toner comes into contact with the cleaning roller 101 in a cleaning operation, thereby effectively removing the toner from the belt. Although the cleaning device 100 functions to remove toner in this description, the cleaning device 100 may also function to remove paper dust deposited on the belt, thereby achieving two functions with the same member.

As shown conceptually in FIGS. 4A and 4B, the cleaning roller 101 in the printer 1 according to the preferred embodiment is capable of contacting and separating from the paper-conveying belt 6. Specifically, when not performing a cleaning operation, the cleaning roller 101 is in a separated position shown in FIG. 4A. When performing a cleaning operation, the cleaning roller 101 is moved next to and in contact with the paper-conveying belt 6, as shown in FIG. 4B. When the paper-conveying belt 6 is being cleaned, the paper-conveying belt 6 is pinched between the cleaning roller 101 and the backup roller 110.

Figure 5:
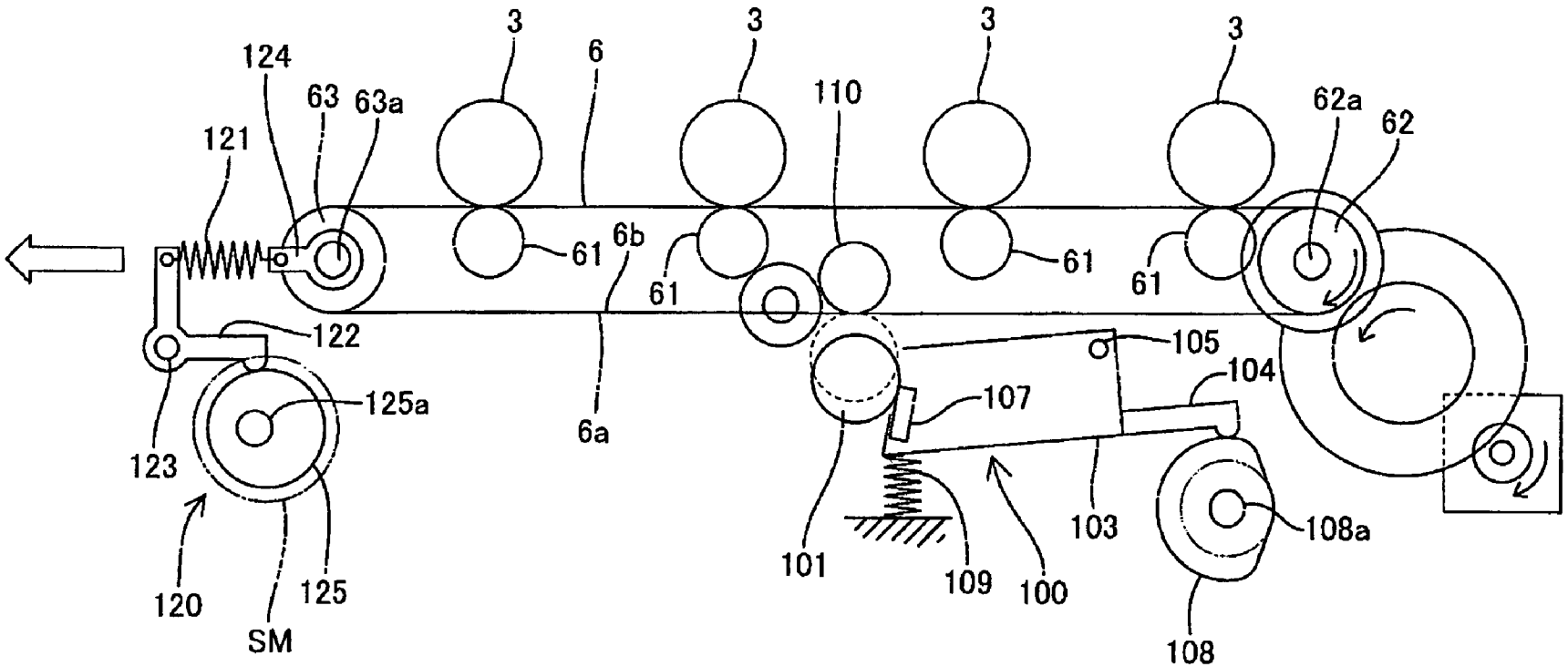
FIG. 5 is an explanatory diagram illustrating a belt driving structure during a transfer operation according to a first embodiment of the present invention.
Figure 6:
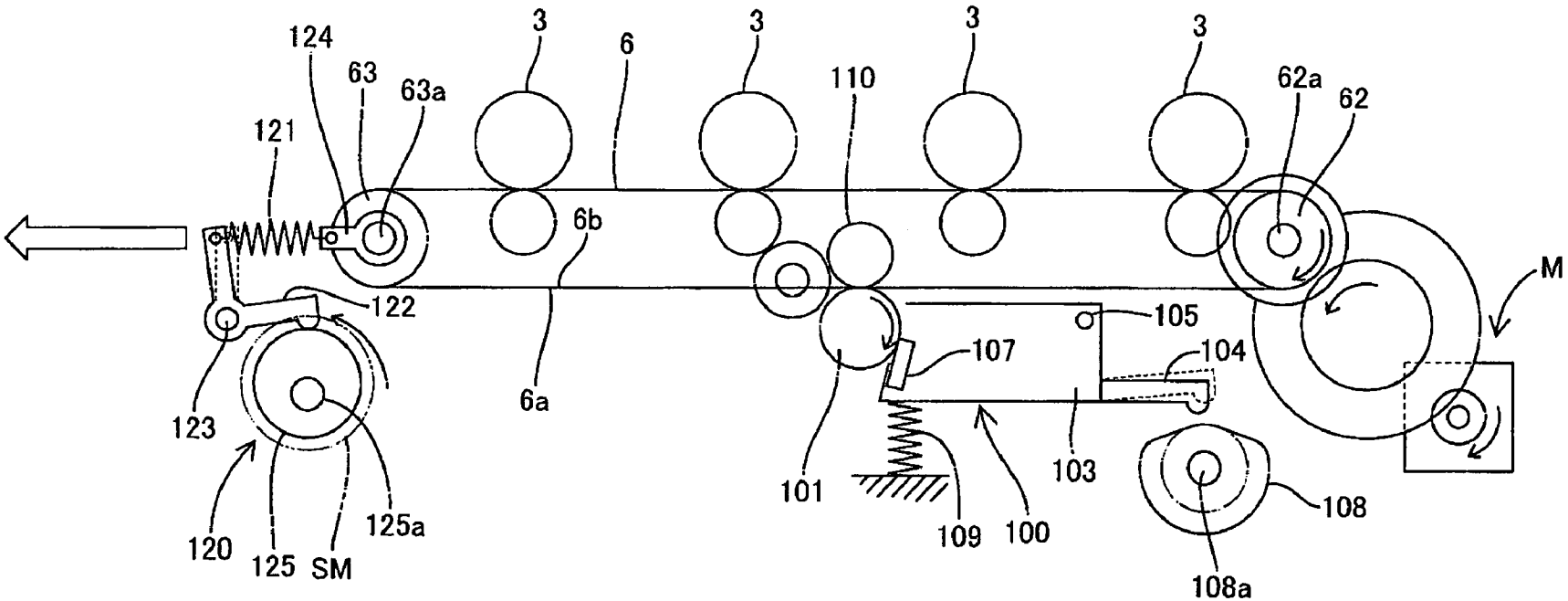
FIG. 6 is an explanatory diagram illustrating the belt driving structure during cleaning according to a first embodiment of the present invention.

More specifically, as shown in FIGS. 1, 5, and 6, the entire cleaning device 100 including the cleaning roller 101, cleaning blade 107, and collecting box 103 is capable of rotating about a shaft 105 extending parallel to the shaft 62*a* of the drive roller 62. By rotating the cleaning device 100 about the shaft 105, the cleaning device 100 can be moved between a separated position in which the cleaning roller 101 is separated from the paper-conveying belt 6 and a contact position in which the cleaning roller 101 abuts the paper-conveying belt 6 (indicated by 101 in FIG. 1).

Further, spring members 109 urge the entire cleaning device 100 toward the contact position. When moved to the separated position, the entire cleaning device 100 is displaced downward against the urging force of the spring members 109, as shown in FIG. 5. When moved to the contact position, the urging force of the spring members 109 places the cleaning roller 101 in contact with the paper-conveying belt 6, as shown in FIG. 6. Movement of the cleaning device 100 is accomplished with cams 108 that are supported on a rotatable camshaft 108*a* (see FIGS. 5 and 6).

The cams 108 displace the cleaning device 100 through contact with operating parts 104 disposed on the collecting box 103 of the cleaning device 100. When the rotational position of the cams 108 is as shown in FIG. 5, the cams 108 apply a force to the cleaning device 100 via the operating parts 104, pushing the cleaning roller 101 downward against the urging force of the spring members 109. When the cams 108 are in the rotational position shown in FIG. 6, the cams 108 no longer transfer a force to the cleaning device 100 and, hence, the urging force of the spring members 109 lifts the cleaning device 100 upward so that the cleaning roller 101 is pressed against the paper-conveying belt 6. Here, the spring members 109 are supported on the frame (not shown in FIGS. 5 and 6) fixed to the main casing 1*a*.

Next, a tension-adjusting mechanism 120 will be described. In the preferred embodiment, the paper-conveying belt 6 is cleaned by pinching the paper-conveying belt 6 between the cleaning roller 101 and the backup-roller 110. However, this configuration applies a large load to the paper-conveying belt 6 due to the pinching of the cleaning roller 101 and backup roller 110, producing slack in the paper-conveying belt 6, as shown in FIG. 4B, so that the movement of the paper-conveying belt 6 tends to become unstable. Hence, the printer 1 of the preferred embodiment includes the tension-adjusting mechanism 120 that is capable of adjusting the tension-state of the paper-conveying belt 6 in order to effectively reduce slack in the paper-conveying belt 6, even when the conditions are conducive to generating slack.

The tension-adjusting mechanism 120 is configured to change the tension state of the paper-conveying belt 6 between a first tension state used when transferring toner images from the photosensitive drums 3, and a second tension state for generating a greater tension than that in the first tension state. In other words, the tension-adjusting mechanism 120 can produce a tension state in the paper-conveying belt 6 that is greater than the first tension state used for transfer operations.

As described above, the paper-conveying belt 6 is supported in the printer 1 by the drive roller 62 and follower roller 63. The spring members 121 urge the follower roller 63 in a direction away from the drive roller 62. However, by adjusting the load applied to the follower roller 63 by the spring members 121, the tension-adjusting mechanism 120 can adjust the tension state generated in the paper-conveying belt 6.

The tension-adjusting mechanism 120 includes rotating members 122 that are rotatably supported on a shaft 123. The shaft 123 is arranged parallel to the shaft 63*a* of the follower roller 63. One end of each spring member 121 is fixed to an end of the corresponding rotating member 122, while the other end is attached to the retaining member 124, which is mounted on the shaft 63*a* of the follower roller 63, as described above. Accordingly, when the rotating members 122 rotate on the shaft 123, the ends of the spring members 121 attached to the rotating members 122 move closer to or away from the drive roller 62, thereby adjusting the force applied to the retaining members 124 (a force in a direction away from the drive roller 62). More specifically, the rotating members 122 are positioned so as to contact cams 125. The cams 125 are supported on a shaft 125*a*. The shaft 125*a* is rotatably supported in the frame fixed to the main casing 1*a* and arranged parallel to the shaft 123 of the rotating members 122 and the shaft 63*a* of the follower roller 63. Displacement of the cams 125 determines the rotational position of the rotating members 122 and, consequently, sets the amount of load applied by the spring members 121.

In the preferred embodiment, displacement of the cams 125 corresponds with displacement of the cams 108. Specifically, while the cleaning roller 101 is configured to approach and separate from the paper-conveying belt 6 in the preferred embodiment, the tension-adjusting mechanism 120 sets the paper-conveying belt 6 to the first tension state in association with the cleaning roller 101 separating from the paper-conveying belt 6, and sets the paper-conveying belt 6 to the second tension state in association with the cleaning roller 101 abutting the paper-conveying belt 6.

In other words, during a transfer operation, the displacement of the cams 125 is set so that the paper-conveying belt 6 is in the first tension state, as shown in FIG. 5. At this time, the spring members 121 generate an appropriate load to produce suitable tension in the paper-conveying belt 6 for performing transfer operations. At the same time, the displacement of the cams 108 is set so that the cleaning device 100 is pushed downward.

When cleaning the paper-conveying belt 6 with the cleaning device 100, the cams 108 separate from the operating parts 104, as shown in FIG. 6, so that the cleaning roller 101 is in contact with the paper-conveying belt 6. At the same time, displacement of the cams 125 is set to produce the second tension state in the paper-conveying belt 6. Specifically, the cams 125 are set as shown in FIG. 6, producing a greater load in the spring members 121 than in the state shown in FIG. 5. Hence, the spring members 121 pull stronger on the follower roller 63 than during the transfer operation shown in FIG. 5.

With this construction, the tension in the paper-conveying belt 6 is set higher in a cleaning operation than in a transfer operation, since a larger load is applied to the paper-conveying belt 6 when cleaning. Accordingly, this construction can effectively prevent sagging or other problems in the paper-conveying belt 6 caused by the load applied thereto. Hence, this construction ensures that the paper-conveying belt 6 moves with stability, thereby achieving stable cleaning.

When the paper-conveying belt 6 is at rest, the tension-adjusting mechanism 120 can set the tension produced in the paper-conveying belt 6 to a third tension state that produces a smaller tension than that in the first tension state. This third tension state can be employed as a measure to prevent the paper-conveying belt 6 from becoming misshapen. If the paper-conveying belt 6 is in a halted state for a long period of time while the tension in the paper-conveying belt 6 is kept high, for example, portions of the paper-conveying belt 6 that contact the drive roller 62 and follower roller 63 may begin to take on the shape of the drive roller 62 and follower roller 63 at the contact surface, which can lead to irregular transfers and other problems.

Figure 7:
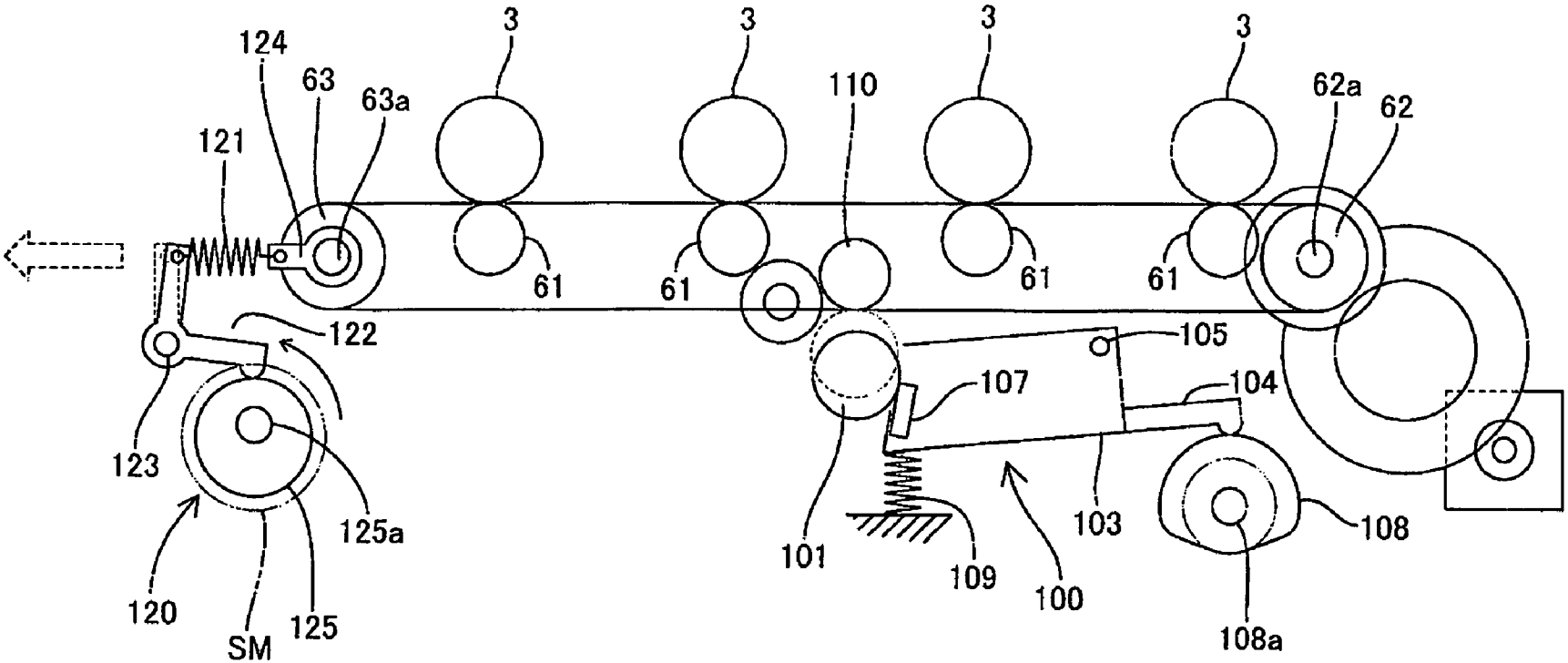
FIG. 7 is an explanatory diagram illustrating the belt in a halted state according to a first embodiment of the present invention.

More specifically, the displacement of the cams 125 is set as shown in FIG. 7, so that the rotating members 122 rotate downward, setting the load in the spring members 121 less than that during a transfer operation (the state shown in FIG. 5). At this time, the cams 108 are positioned according to the displacement of the cams 125 and hold the cleaning device 100 in a state in which the cleaning roller 101 does not contact the paper-conveying belt 6.

One method of setting the displacement in the cams 125 is through use of a stepping motor SM, as shown in FIG. 5. More specifically, the stepping motor SM in the preferred embodiment is configured to drive the cams 108 under the control of the controller 10 (see FIG. 1) described above. The controller 10 sets the displacement of the stepping motor SM depending on whether the paper-conveying belt 6 is performing a transfer, being cleaned, or at rest, thereby setting the cams 108 in the states shown in FIGS. 5, 6, and 7. This configuration is only one example, and it should be apparent that the present invention is not limited to any structure, provided that the structure can set the cams 108 to a position corresponding to the states used for a transfer operation, a cleaning operation, and when the paper-conveying belt 6 is at rest.

The associated rotating operations of the cams 125 and cams 108 can be configured via gears or other components. Alternatively, a stepping motor may be provided for each of the cams 125 and cams 108, and the controller 10 can control both stepping motors to move in association with each other so that displacement in the cams 125 and cams 108 is varied associatively.

Figure 8A:
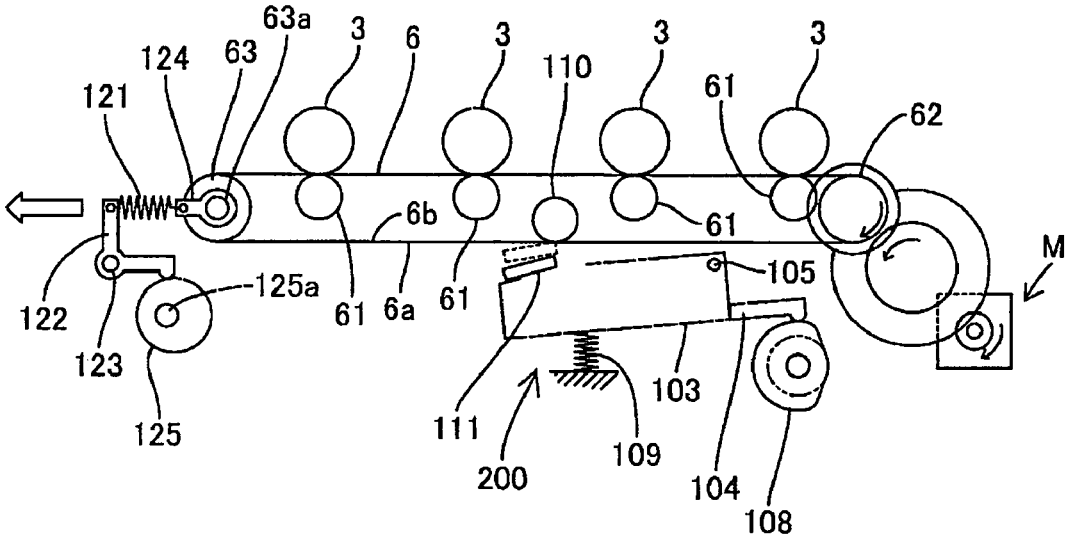
FIG. 8A is an explanatory diagram illustrating the structure of a belt unit during a transfer operation according to a second embodiment of the present invention.
Figure 8B:
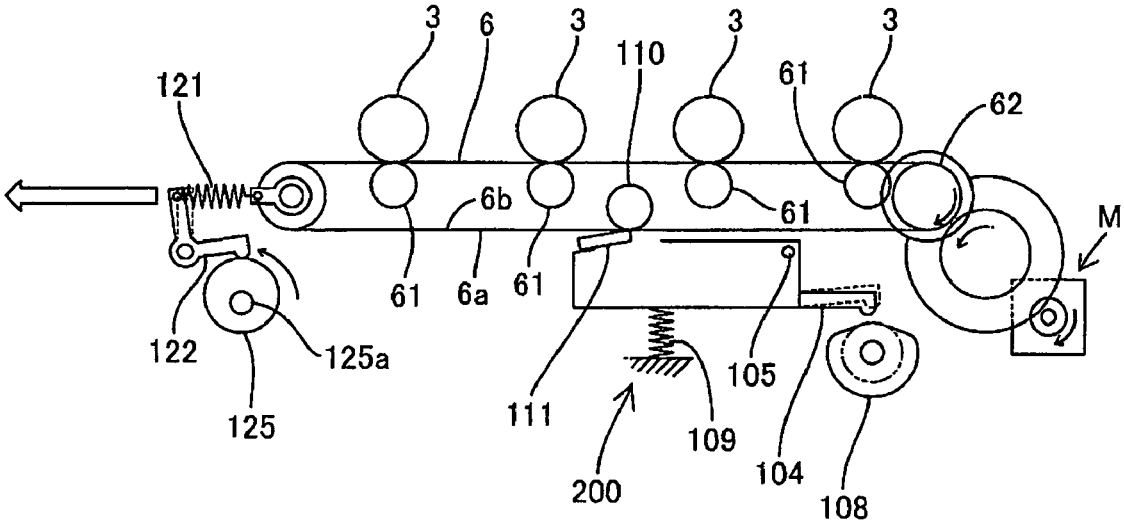
FIG. 8B is an explanatory diagram illustrating the structure of a belt during a cleaning operation according to a second embodiment of the present invention.

Next, a belt unit according to a second embodiment of the present invention will be described with reference to FIG. 8.

While the cleaning member of the first embodiment described above is configured of a cleaning roller, the cleaning member according to the second embodiment is configured of a blade member 111 that is incapable of rotating and that contacts and scrapes the outer surface of the belt. Since the remaining structure of the belt unit according to the second embodiment is identical to that described in the first embodiment, like parts and components are designated with the same reference numerals to avoid duplicating description. As in the first embodiment, the cleaning device 200 according to the second embodiment is configured to rotate in response to displacement of the cams 108. As the cleaning device 200 rotates, the blade member 111 moves into contact with the paper-conveying belt 6 and separates therefrom.

As in the first embodiment, the tension-adjusting mechanism 120 according to the second embodiment can switch the tension state of the paper-conveying belt 6 between the first tension state (shown in FIG. 8A) for transferring toner images from the photosensitive drums 3 to a second tension (FIG. 8B) for producing a tension greater than that in the first tension state required for cleaning. While not shown in FIGS. 8A and 8B, the tension-adjusting mechanism 120 can also set the tension of the paper-conveying belt 6 when the paper-conveying belt 6 is at rest to a third tension state generating a smaller tension than that during a transfer operation.

Next, an image-forming device according to a third embodiment of the present invention will be described with reference to FIG. 9. While the preferred embodiments described above cover a structure for changing tension in a paper-conveying belt, the third embodiment describes a structure for changing the tension state of an intermediate transfer belt. Other than the fact that an intermediate transfer belt is the subject of tension adjustments, the remaining structure of the image-forming device (such as the drive roller 62, follower roller 63, and cleaning device 100) is identical to that described in FIG. 1 and, therefore, like parts and components are designated with the same reference numerals to avoid duplicating description.

Figure 9:
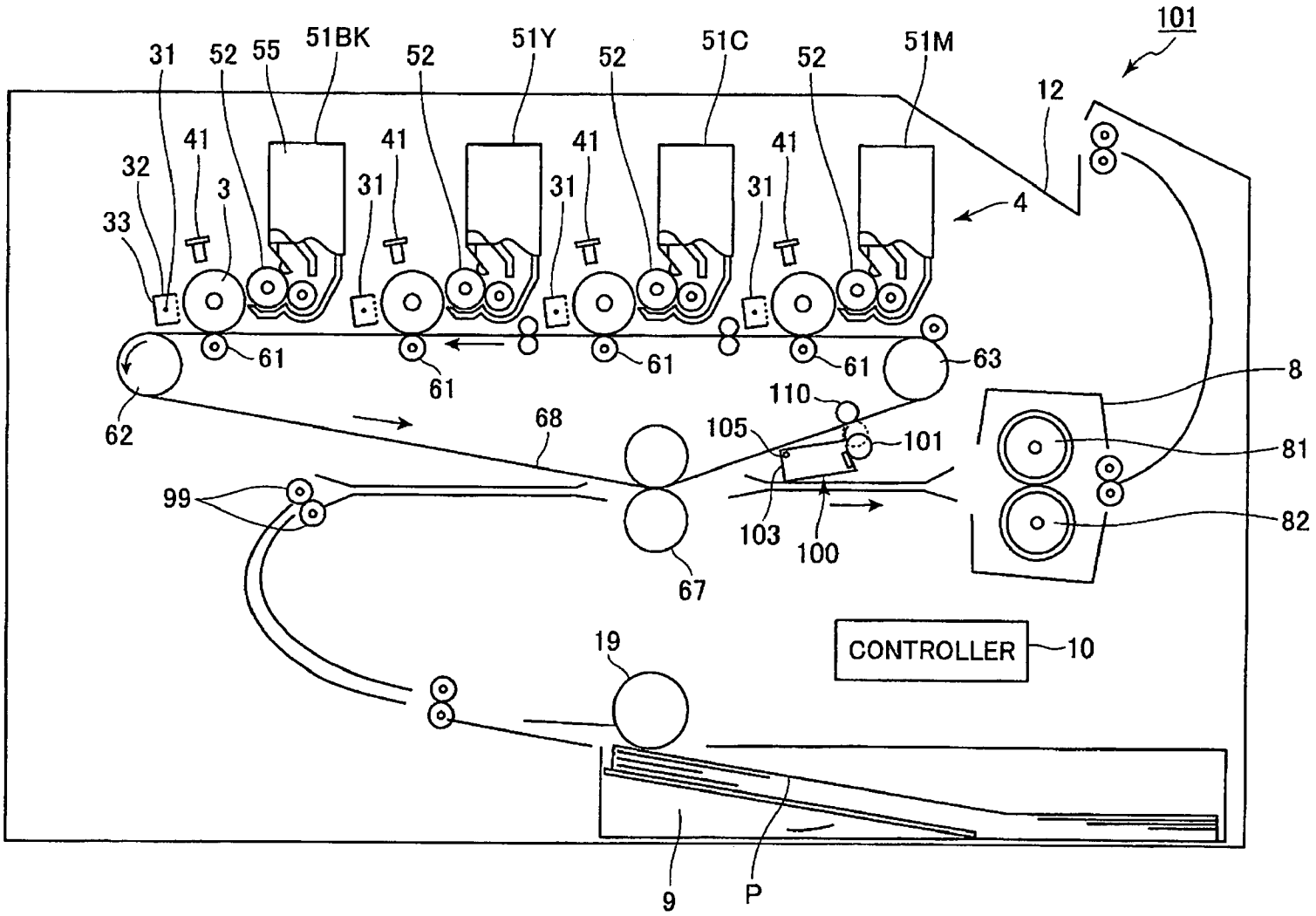
FIG. 9 is a cross-sectional view of an image-forming device according to a third embodiment of the present invention.

The printer 101 in FIG. 9 is configured as an intermediate transfer type printer having an intermediate transfer belt 68 functioning to relay toner images carried on the photosensitive drum 3 to a transfer position for transferring the images onto paper. In this construction, toner images formed on the four photosensitive drums 3 in four different colors are transferred onto the intermediate transfer belt 68 temporarily. Subsequently, the toner images carried on the intermediate transfer belt 68 are transferred onto the paper P as the paper P passes through a contact position between the intermediate transfer belt 68 and a secondary roller 67.

Since toner images are directly transferred onto the belt in a system using an intermediate transfer belt, cleaning is vital to achieve high precision image formation. Hence, as in the first embodiment, the printer 1 according to the third embodiment includes the cleaning device 100 disposed adjacent to the intermediate transfer belt 68. Further, in order to improve the cleaning performance, the tension state of the intermediate transfer belt 68 is switched between a first tension state for transferring toner images from the photosensitive drum 3 onto the intermediate transfer belt 68, and a second tension state for generating a tension greater than that in the first tension state in order to perform cleaning.

The mechanism for adjusting the tension state in the belt is identical to that described in the first embodiment. By adjusting the urging force applied to the follower roller 63 (an urging force provided by a spring member (not shown) in a direction away from the drive roller 62), the tension-adjusting mechanism switches between the first tension state and the second tension state. As in the first embodiment, the tension-adjusting mechanisms can adjust the tension state to a third tension state for producing a tension smaller than that in the first tension state. The associated structures of the follower roller 63 and cleaning device 100 are also identical to that described in the first embodiment.

While the invention has been described in detail with reference to specific embodiments thereof, it would be apparent to those skilled in the art that many modifications and variations may be made therein without departing from the spirit of the invention, the scope of which is defined by the attached claims.

While the image-forming device in the preferred embodiments described above is a color laser printer, the image-forming device may be another type of printer, such as a monochrome laser printer; or a device other than a printer, such as a facsimile device or a multifunction device having a printer function, scanner function, and the like.

While the belt in the preferred embodiments described above is a paper-conveying belt or an intermediate transfer belt, the belt according to the present invention may be a photosensitive belt that is exposed by light to form electrostatic latent images thereon. This type of belt is used when the image-forming device is configured to perform image-on image development (either the single-pass or multi-pass method).

In the preferred embodiments described above, the belt is set to a higher tension during cleaning (second tension state) than during a transfer operation. However, the timing at which the belt is set to the second tension state is not limited to this construction. For example, the belt may be put in the second tension state prior to a transfer operation to remove any misshapenness in the belt.

What is claimed is:

1. An image-forming device comprising:

an image-carrying member that carries a developer image;

a plurality of support members;

an endless belt disposed in confrontation with the image-carrying member and supported on the plurality of support members to circularly move there around;

a transferring member that transfers the developer image in a direction from the image-carrying member to the endless belt;

a tension-adjusting mechanism that adjusts a tension generated in the endless belt between a first tension at which the developer image is transferred in the direction from the image-carrying member to the endless belt and a second tension greater than the first tension; and a cleaning unit that cleans an outer surface of the endless belt and comprises a cleaning roller disposed in opposition to the outer surface of the endless belt, and a backup roller disposed in opposition to the cleaning roller with the endless belt interposed between the backup roller and the cleaning roller, wherein the cleaning roller and the backup roller are configured to selectively provide one of a first state in which the cleaning roller and the backup roller pinch the endless belt and a second state in which the endless belt is free from the pinching by the cleaning roller and the backup roller, and wherein the tension-adjusting mechanism sets the second tension in the endless belt, and the cleaning roller and the backup roller are in the first state when the cleaning unit is cleaning the endless belt.

2. The image-forming device according to claim 1, wherein the tension-adjusting mechanism sets the tension in the endless belt to a third tension less than the first tension when the belt has stopped moving.

3. The image-forming device according to claim 1, wherein the endless belt is a conveying belt that conveys a recording medium in a state confronting the image-carrying member.

4. The image-forming device according to claim 1, wherein the endless belt is an intermediate transfer belt; and the image-carrying member transfer the developer images onto an outer surface of the intermediate transfer belt.

5. The image-forming device according to claim 1, wherein the cleaning unit has a scraping member that scrapes the outer surface of the endless belt.

6. The image-forming device according to claim 1, further comprising a driving unit, wherein the support members comprise a drive roller driven by the driving unit, and a follower roller, and the tension-adjusting mechanism comprises an urging unit that varies an urging force applied to the endless belt to adjust the tension of the endless belt.

7. The image-forming device according to claim 6, wherein the urging unit is connected to the follower roller to urge the follower roller in a direction away from the drive roller.

8. A belt unit comprising:

a plurality of support members;

an endless belt supported on the plurality of support members to circularly move there around;

a tension-adjusting mechanism that adjusts a tension generated in the endless belt between a first tension at which a developer image is transferred in a direction from an image-carrying member to the endless belt and a second tension greater than the first tension; and a cleaning unit that cleans an outer surface of the endless belt and comprises a cleaning roller disposed in opposition to the outer surface of the endless belt, and a backup roller disposed in opposition to the cleaning roller with the endless belt interposed between the backup roller and the cleaning roller, wherein the cleaning roller and the backup roller are configured to selectively provide one of a first state in which the cleaning roller and the backup roller pinch the endless belt and a second state in which the endless belt is free from the pinching by the cleaning roller and the backup roller, and wherein the tension-adjusting mechanism sets the second tension in the endless belt, and the cleaning roller and the backup roller are in the first state when the cleaning unit is cleaning the endless belt.

9. The belt unit according to claim 8, wherein the tension-adjusting mechanism sets the tension in the endless belt to a third tension less than the first tension when the belt has stopped moving.

10. The belt unit according to claim 8, wherein the support members comprises a drive roller driven by a driving unit, and a follower roller, and the tension-adjusting mechanism comprises an urging unit that varies an urging force applied to the endless belt to adjust the tension of the endless belt.

11. The belt unit according to claim 10, wherein the urging unit is connected to the follower roller to urge the follower roller in a direction away from the drive roller.

* * * * *

UNITED STATES PATENT AND TRADEMARK OFFICE

CERTIFICATE OF CORRECTION

PATENT NO. : 7,593,664 B2
APPLICATION NO. : 11/376115
DATED : September 22, 2009
INVENTOR(S) : Yasushi Okabe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 349 days.

Signed and Sealed this

Twenty-eighth Day of September, 2010

David J. Kappos

David J. Kappos
*Director of the United States Patent and Trademark Office*